US008777672B2

(12) United States Patent
Chung et al.

(10) Patent No.: US 8,777,672 B2
(45) **Date of Patent: *Jul. 15, 2014**

(54) USB FEMALE CONNECTOR

(71) Applicant: Kuang Ying Computer Equipment Co., Ltd., New Taipei (TW)

(72) Inventors: Hsuan-Ho Chung, New Taipei (TW); Yu-Hung Lin, New Taipei (TW); Chih-Ming Hsu, New Taipei (TW)

(73) Assignee: Kuang Ying Computer Equipment Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/664,395

(22) Filed: Oct. 30, 2012

(65) Prior Publication Data

US 2013/0109233 A1 May 2, 2013

(30) Foreign Application Priority Data

Nov. 2, 2011 (TW) ..... 100220664 U

(51) Int. Cl.

| | |
|---|---|
| ***H01R 24/00*** | (2011.01) |
| ***H01R 13/6594*** | (2011.01) |
| ***H01R 12/16*** | (2006.01) |

(52) U.S. Cl.

CPC ..... *H01R 13/6594* (2013.01); *H01R 23/7073* (2013.01)

USPC ..... 439/660; 439/607.35

(58) Field of Classification Search

CPC ..... H01R 13/6594; H01R 13/6597; H01R 23/7073; H01R 23/7084

USPC ..... 439/607.31–607.4, 660

See application file for complete search history.

(56) References Cited

U.S. PATENT DOCUMENTS

| | | | | |
|---|---|---|---|---|
| 8,444,439 | B2 * | 5/2013 | Cao et al. | 439/607.35 |
| 8,454,387 | B2 * | 6/2013 | Peng et al. | 439/607.35 |
| 8,475,211 | B2 * | 7/2013 | Wang et al. | 439/607.38 |
| 2010/0240255 | A1 * | 9/2010 | He et al. | 439/607.35 |
| 2013/0252466 | A1 * | 9/2013 | Chen | 439/607.35 |

* cited by examiner

*Primary Examiner* — Khiem Nguyen

(74) *Attorney, Agent, or Firm* — Leong C. Lei

(57) ABSTRACT

The USB female connector contains an insulating base and a shielding casing enclosing the insulating base. On the insulating base, there is mainly a ground terminal having a flat ground contact section at an end on the insulating base. From the ground contact section, the ground terminal is forked into ground extension sections. Through the forked ground extension sections, the crosstalk on the first, second, third, and fourth differential signal terminals by the first and second signal terminals is effectively resolved.

10 Claims, 9 Drawing Sheets

USB FEMALE CONNECTOR

TECHNICAL FIELD OF THE INVENTION

The present invention generally relates to USB female connectors, and especially relates to a USB female connector immune from the crosstalk problem resulted from high-frequency signal.

DESCRIPTION OF THE PRIOR ART

USB connectors are widely applied and, especially in recent days, the transmission frequency of USB connectors is increased significantly.

EMI (electromagnetic interference) is an electromagnetic phenomenon that the performance of a device, apparatus, or system is compromised, or the function of an organism or a substance is affected, by the electromagnetic field resulted from the operation of electrical voltage or current. Usually a shield is employed to protect the components of the device, apparatus, or system from EMI, or to prevent electromagnetic field produced by the components of the device, apparatus, or system from affecting other devices nearby. However, the shield does not always work. On the other hand, a frequent result of EMI is the so-called crosstalk. Crosstalk refers to the interference between signals on adjacent communication channels. When the transmission distance is long, the adjacent channels are too close, or the difference in signal intensities is too great, the possibility of occurrence of crosstalk also increases.

Therefore, how to resolve the EMI and crosstalk problems is a main concern to the present inventor and other manufacturers for the USB connectors.

SUMMARY OF THE INVENTION

Therefore a novel USB female connector is provided herein so as to resolve the crosstalk problem.

A major objective of the present invention is that the crosstalk on a first, second, third, and fourth differential signal terminals from a first and second signal terminals on the USB female connector is effectively resolved through forked ground extension sections. And this objective is achieved under the same space limitation.

To achieve the objective, the USB female connector contains an insulating base and, on the insulating base, a ground terminal, a first signal terminal, a second signal terminal, a first ground terminal, a first differential signal terminal, a second differential signal terminal, a first power terminal, a third differential signal terminal, and a fourth differential signal terminal. The ground terminal has a flat ground contact section at an end on the insulating base. From the ground contact section, the ground terminal is extended away from the insulating base and forked into ground extension sections. Through the forked ground extension sections, the high-frequency crosstalk problem is effectively resolved. In addition, the insulating base is enclosed in a shielding casing and, as such, the problems such as packet loss or signal attenuation from EMI when transmission distance is extended are also effectively resolved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
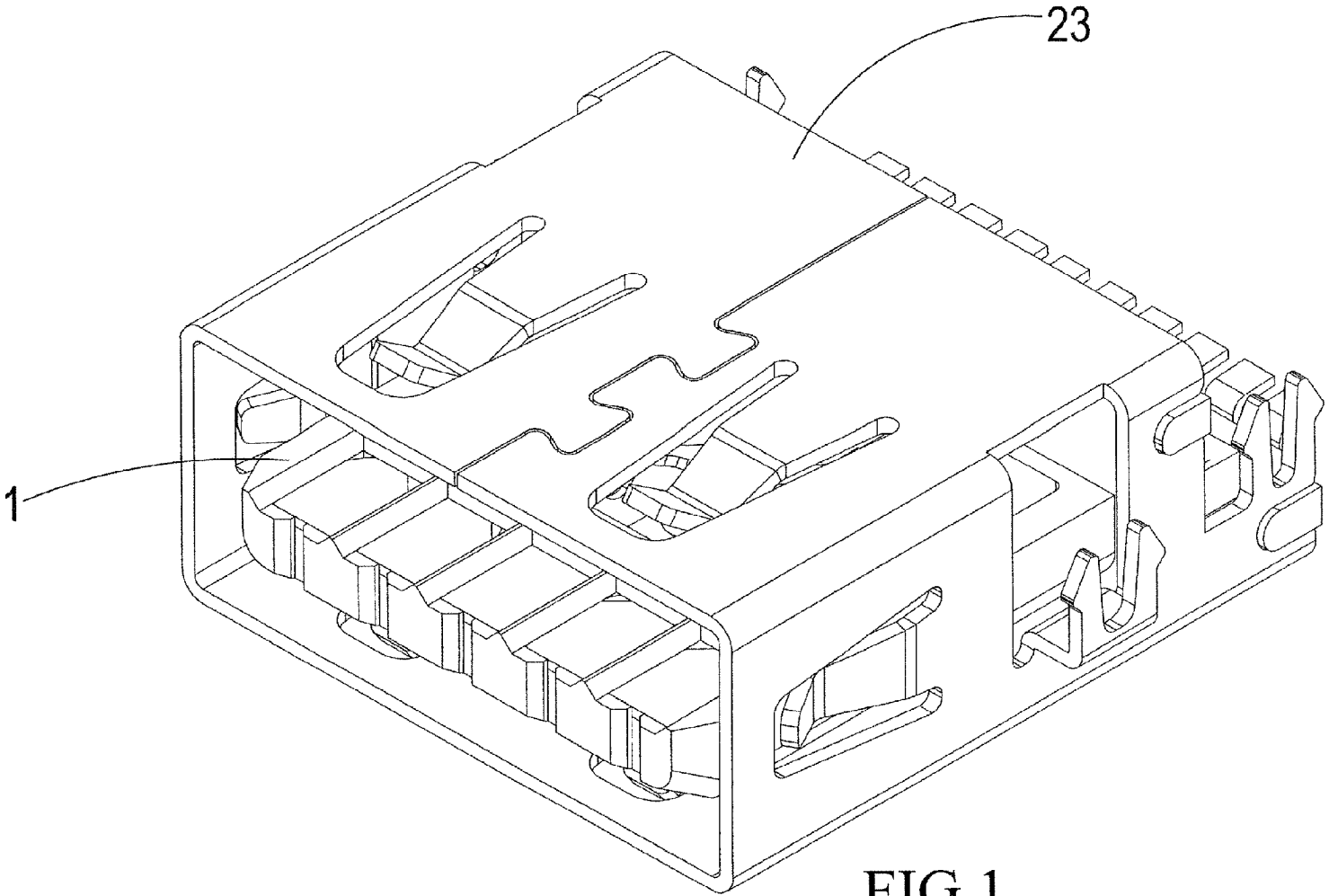
FIG. 1 is a perspective diagram showing a USB female connector according a first embodiment of the present invention.
Figure 2:
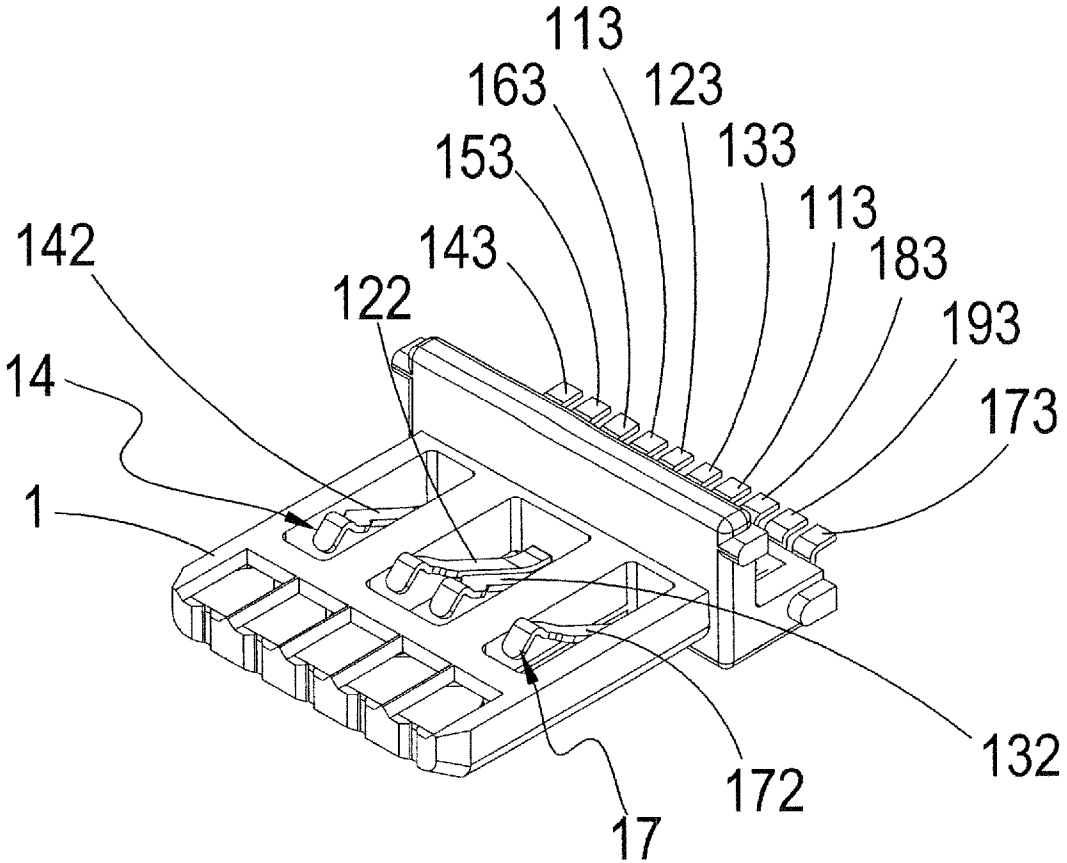
FIG. 2 is a perspective schematic diagram showing the terminals as they are integrated with the insulating base of the USB female connector of FIG. 1.
Figure 2A:
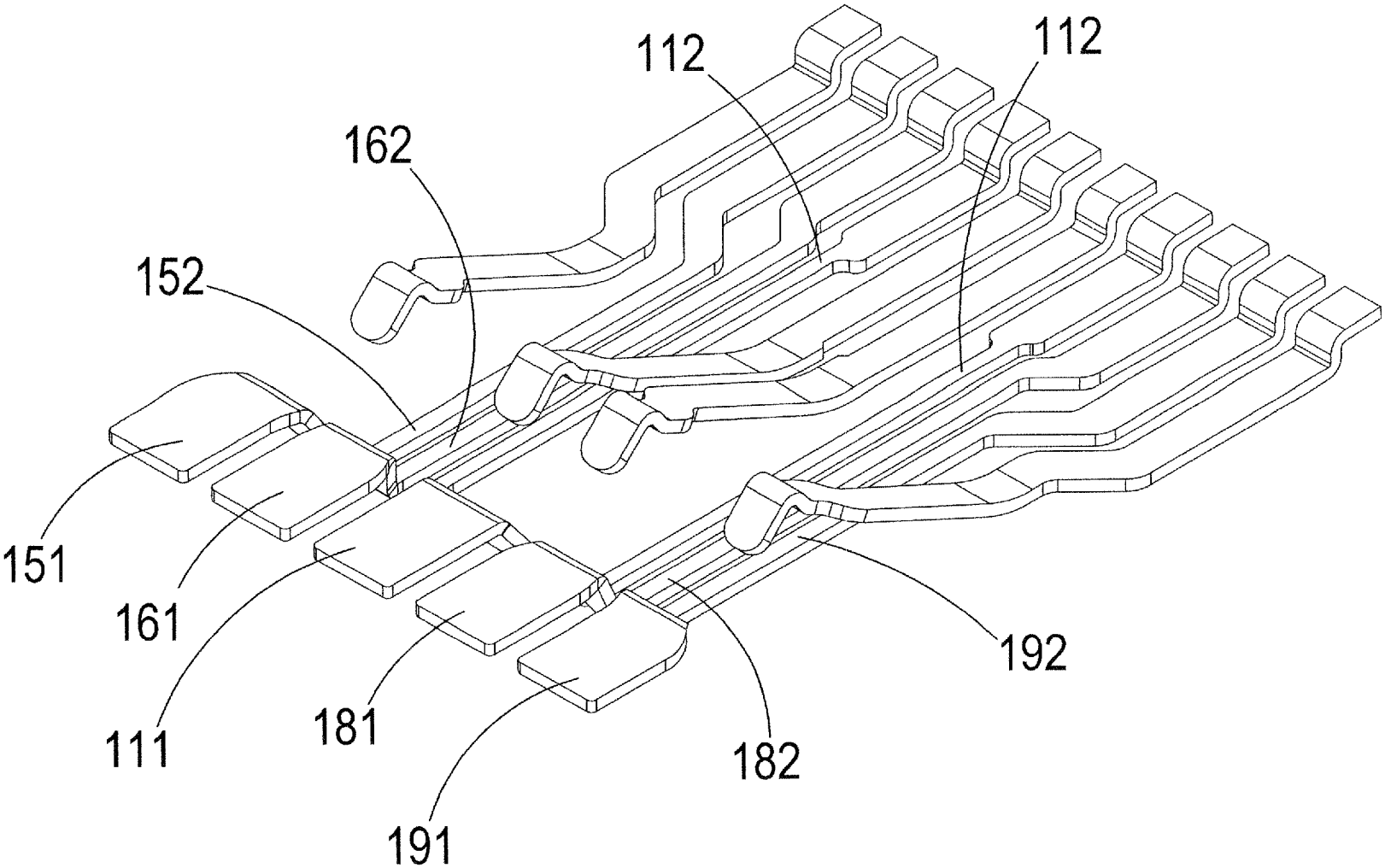
FIG. 2A is a perspective diagram showing the terminals of the USB female connector of FIG. 1.
Figure 3:
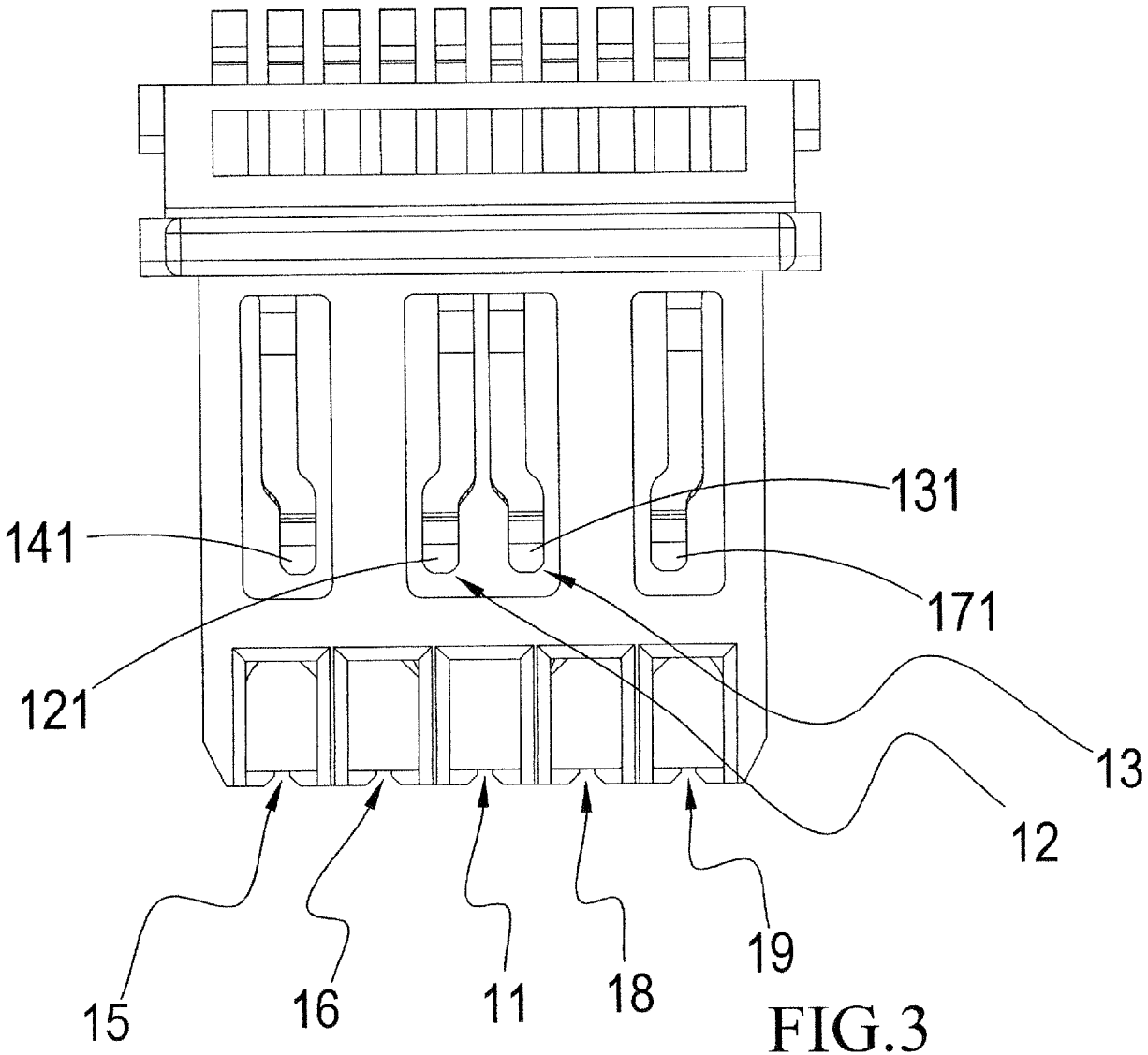
FIG. 3 is a top-view schematic diagram showing the terminals as they are integrated with the insulating base of the USB female connector of FIG. 1.
Figure 4:
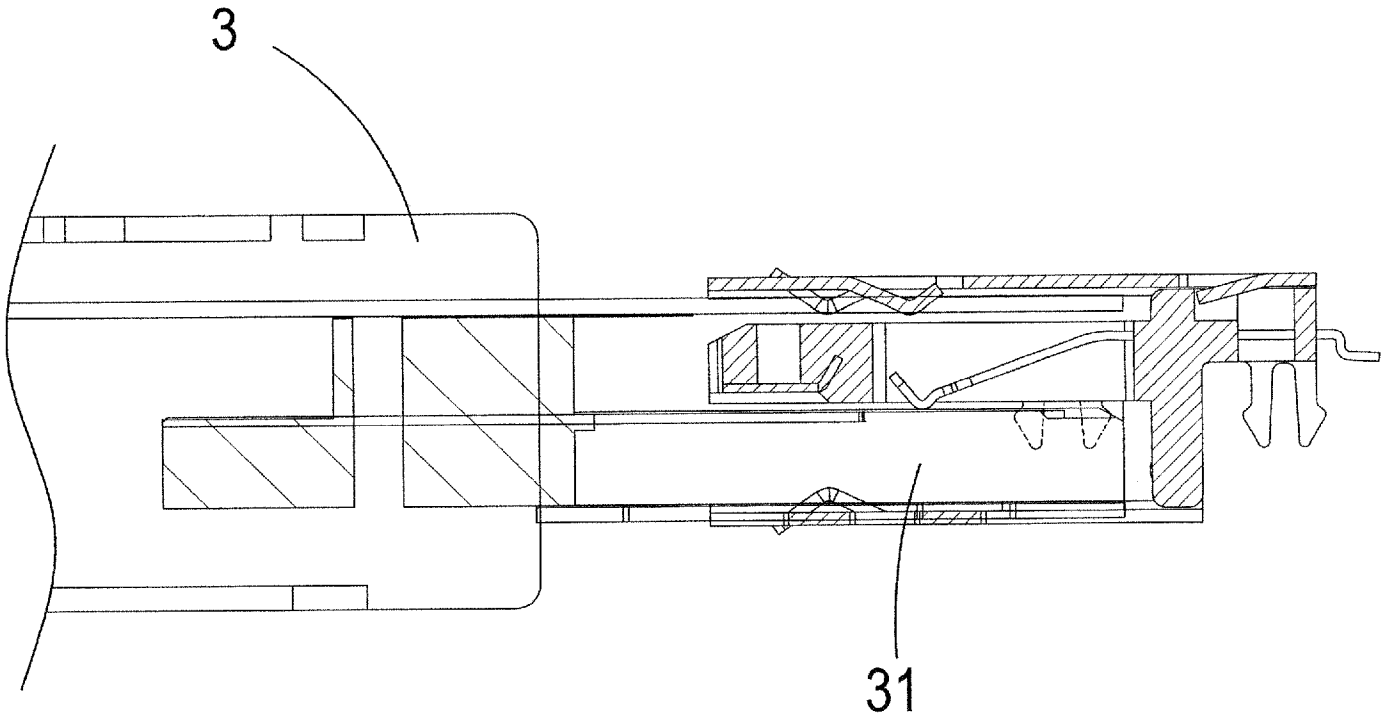
FIG. 4 is a sectional schematic diagram showing a USB male connector plugged into the USB female connector of FIG. 1.

As shown in FIGS. 1 to 3, a USB female connector according to a first embodiment of the present invention contains the following components.

There is an insulating base 1.

There is a metallic ground terminal 11 on the insulating base 1. The ground terminal 11 has a ground contact section 111 at an end on the insulating base 1. From the ground contact section 111, the ground terminal 11 is extended away from the insulating base 1 into two ground extension sections 112. The ground extension sections 112 are for isolating the crosstalk produced by a first signal terminal 12 and a second differential signal terminal 16 described below. The ground extension sections 112 are further extended away from the ground contact section 111 into ground soldering sections 113, respectively (therefore, there are two ground soldering sections 113).

There is a metallic first signal terminal 12 on the insulating base 1 between the ground extension sections 112. The first signal terminal 12 has a first signal contact section 121 at an end on the insulating base 1, a first signal extension section 122 extended from the first signal contact section 121, and a first signal soldering section 123 extended from the first signal extension section 122. The first signal soldering section 123 is positioned between the ground soldering sections 113.

There is a metallic second signal terminal 13 on the insulating base 1 between the first signal terminal 12 and a ground extension section 112. The second signal terminal 13 has a second signal contact section 131 at an end on the insulating base 1, a second signal extension section 132 extended from the second signal contact section 131, and a second signal soldering section 133 extended from the second signal extension section 132. The second signal soldering section 133 is positioned between the first signal soldering section 123 and a ground soldering sections 113.

There is a metallic first ground terminal 14 on the insulating base 1 at a side and parallel to the first signal terminal 12. The first ground terminal 14 has a first ground contact section 141 at an end on the insulating base 1, a first ground extension section 142 extended from the first ground contact section 141, and a first ground soldering section 143 extended from the first ground extension section 142. The first ground soldering section 143 is positioned at a side and parallel to a ground soldering section 113.

There is a metallic first differential signal terminal 15 on the insulating base 1 between a first ground extension section 112 and the first ground terminal 14. The first differential signal terminal 15 has a first differential signal contact section 151 at an end on the insulating base 1, a first differential signal extension section 152 extended from the first differential signal contact section 151, and a first differential signal soldering section 153 extended from the first differential signal extension section 152. The first differential signal soldering section 153 is positioned between the first ground soldering section 143 and a ground soldering section 113.

There is a metallic second differential signal terminal 16 on the insulating base 1 between a first differential signal terminal 15 and a ground extension section 112. The second differential signal terminal 16 has a second differential signal contact section 161 at an end on the insulating base 1, a second differential signal extension section 162 extended from the second differential signal contact section 161, and a second differential signal soldering section 163 extended from the second differential signal extension section 162. The second differential signal soldering section 163 is positioned between the first differential signal soldering section 153 and a ground soldering section 113.

There is a metallic first power terminal 17 on the insulating base 1 at a side and parallel to the second signal terminal 13. The first power terminal 17 has a first power contact section 171 at an end on the insulating base 1, a first power extension section 172 extended from the first power contact section 171, and a first power soldering section 173 extended from the first power extension section 172. The first power soldering section 173 is positioned at as side and parallel to a ground soldering section 113.

There is a metallic third differential signal terminal 18 on the insulating base 1 between the first power terminal 17 and a ground extension section 112. The third differential signal terminal 18 has a third differential signal contact section 181 at an end on the insulating base 1, a third differential signal extension section 182 extended from the third differential signal contact section 181, and a third differential signal soldering section 183 extended from the third differential signal extension section 182. The third differential signal soldering section 183 is positioned between the first power soldering section 173 and a ground soldering section 113.

There is a metallic fourth differential signal terminal 19 on the insulating base 1 between the first power terminal 17 and the third differential signal terminal 18. The fourth differential signal terminal 19 has a fourth differential signal contact section 191 at an end on the insulating base 1, a fourth differential signal extension section 192 extended from the fourth differential signal contact section 191, and a fourth differential signal soldering section 193 extended from the fourth differential signal extension section 192. The fourth differential signal soldering section 193 is positioned between the first power soldering section 173 and the third differential signal soldering section 183.

There is a shielding casing 23 enclosing the insulating base 1.

In addition, the first ground terminal 14, the first power terminal 17, the first signal terminal 12, and the second signal terminal 13 are flexibly structured. The ground terminal 11, the first differential signal terminal 15, the second differential signal terminal 16, the third differential signal terminal 18, and the fourth differential signal terminal 19 are structured as stable plates.

The insulating base 1 can be a printed circuit board (PCB), a 3D circuit board, or an insulating plastic member.

The ground terminal 11, the first differential signal terminal 15, the second differential signal terminal 16, the third differential signal terminal 18, the fourth differential signal terminal 19, the first ground terminal 14, the first signal terminal 12, the second signal terminal 13, and the first power terminal are commonly connected to a printed circuit board by single-row SMT, single-row DIP, two-row SMT, or two-row DIP. The ground soldering section 113, the first signal soldering section 123, the second signal soldering section 133, the first ground soldering section 143, the first differential signal soldering section 153, the second differential signal soldering section 163, the first power soldering section 173, the third differential signal soldering section 183, the fourth differential signal soldering section 193 are commonly connected to a printed circuit board by upward bending and extension, downward bending and extension, or continuous bending and extension. For upward bending and extension, it can be flatly laid, raised, vertical, or upright. For downward bending and extension, it can be flatly laid or raised. For continuous bending and extension, it can be forward or backward.

Together with FIGS. 2A to 4, the operation of the USB female connector of the present embodiment is described as follows. As illustrated, when a USB male connector 3 is plugged into the insulating base 1 of the USB female connector, a base board 31 of the USB male connector 3 has its differential signal terminals conducted to the first ground contact section 141, the first signal contact section 121, the second signal contact section 131, the ground contact section 111, the first differential signal contact section 151, the second differential signal contact section 161, the first power contact section 171, the third differential signal contact section 181, and the fourth differential signal contact section 191. In the meantime, the first differential signal contact section 151, the second differential signal contact section 161, the ground contact section 111, the third differential signal contact section 181, and the fourth differential signal contact section 191 are below and ahead of the first ground contact section 141, the first signal contact section 121, the second signal contact section 131, and the first power contact section 171. Together with the forked ground extension sections 112, the crosstalk on the first, second, third, and fourth differential signal terminals 15, 16, 18, and 19 by the first and second signal terminals 12 and 13 can be effectively resolved.

Figure 5:
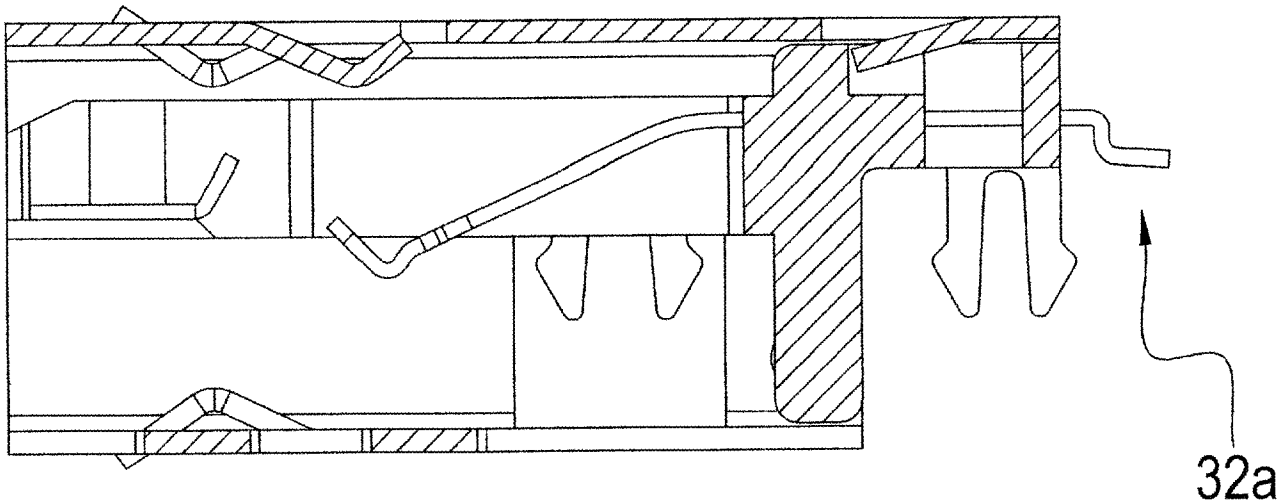
FIG. 5 is a sectional schematic diagram showing the USB female connector of FIG. 1.

As shown in FIG. 5 which shows the first embodiment of the present invention, the ground soldering section, the first signal soldering section, the second signal soldering section, the first ground soldering section, the first differential signal soldering section, the second differential signal soldering section, the first power soldering section, the third differential signal soldering section, the fourth differential signal soldering section are jointly referred to as a terminal set 32*a*, which is implemented by SMT or DIP (the present embodiment is presented using SMT).

Figure 6:
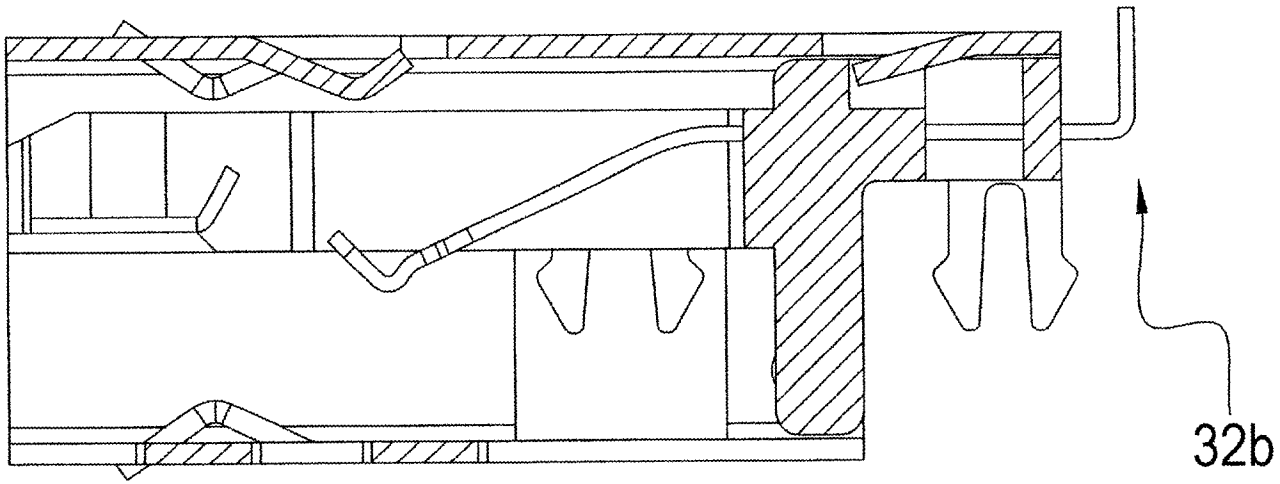
FIG. 6 is a sectional schematic diagram showing a USB female connector according to a second embodiment of the present invention.

As shown in FIG. 6 which shows a second embodiment of the present invention, the ground soldering section, the first signal soldering section, the second signal soldering section, the first ground soldering section, the first differential signal soldering section, the second differential signal soldering section, the first power soldering section, the third differential signal soldering section, the fourth differential signal soldering section are jointly referred to as a terminal set 32*b*, which is implemented by upward bending and extension.

Figure 7:
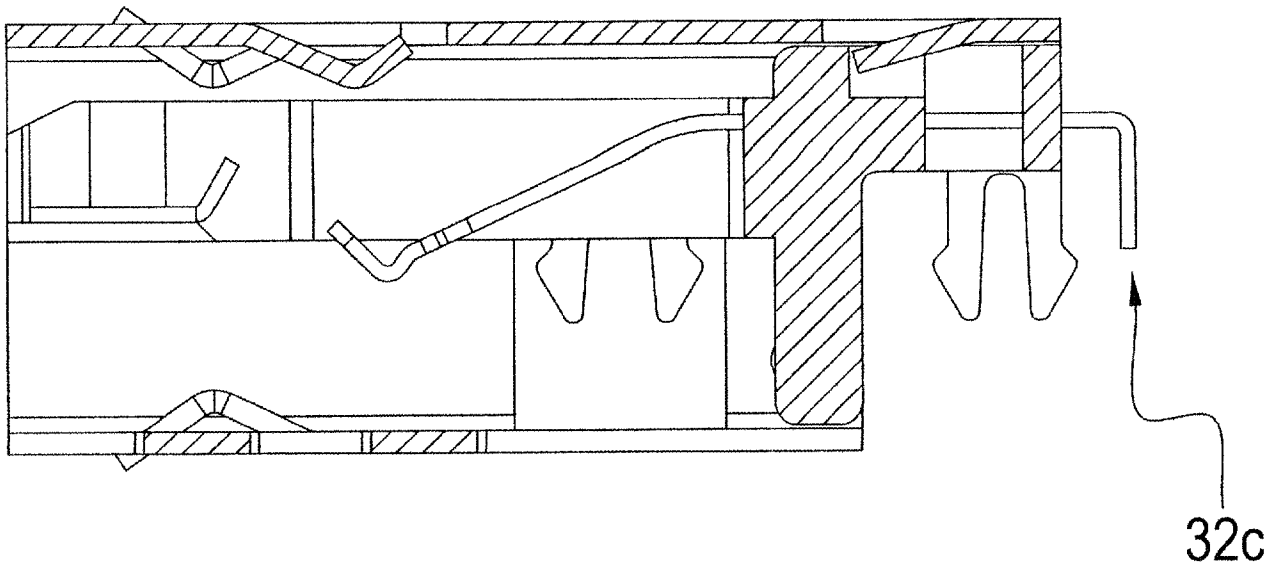
FIG. 7 is a sectional schematic diagram showing a USB female connector according to a third embodiment of the present invention.

As shown in FIG. 7 which shows a third embodiment of the present invention, the ground soldering section, the first signal soldering section, the second signal soldering section, the first ground soldering section, the first differential signal soldering section, the second differential signal soldering section, the first power soldering section, the third differential signal soldering section, the fourth differential signal soldering section are jointly referred to as a terminal set 32*c*, which is implemented by downward bending and extension.

Figure 8:
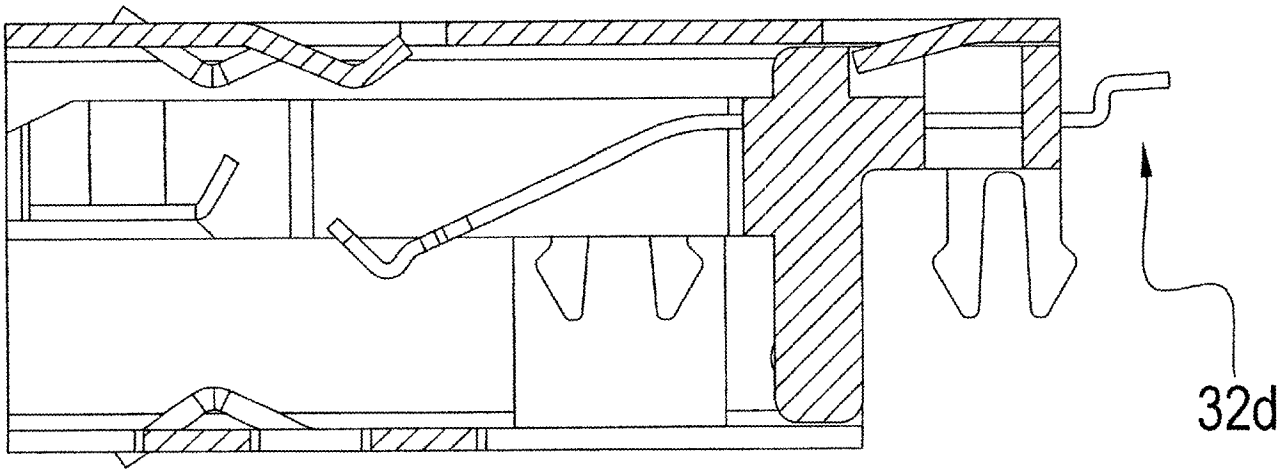
FIG. 8 is a sectional schematic diagram showing a USB female connector according to a fourth embodiment of the present invention.

As shown in FIG. 8 which shows a fourth embodiment of the present invention, the ground soldering section, the first signal soldering section, the second signal soldering section, the first ground soldering section, the first differential signal soldering section, the second differential signal soldering section, the first power soldering section, the third differential signal soldering section, the fourth differential signal soldering section are jointly referred to as a terminal set 32*d*, which is implemented by continuous bending and extension.

Compared to the prior arts, the present invention has the following advantage.

The crosstalk on the first, second, third, and fourth differential signal terminals 15, 16, 18, and 19 from the first and second signal terminals 12 and 13 is effectively resolved through the forked ground extension sections 112.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A USB female connector, comprising an insulating base;

a metallic ground terminal on the insulating base having a ground contact section at an end of the insulating base and, from the ground contact section, extended toward the other end and forked into a plurality of ground extension sections;

a metallic first signal terminal on the insulating base between the ground extension sections;

a metallic second signal terminal on the insulating base between the a ground extension section and the first signal terminal;

a metallic first ground terminal on the insulating base at the side and parallel to the first signal terminal;

a metallic first differential signal terminal on the insulating base between a ground extension section and the first ground terminal;

a metallic second differential signal terminal on the insulating base between a ground extension section and the first differential signal terminal;

a metallic first power terminal on the insulating base at the side and parallel to the second signal terminal;

a metallic third differential signal terminal on the insulating base between a ground extension section and the first power terminal;

a metallic fourth differential signal terminal on the insulating base between the first power terminal and the third differential signal terminal; and a shielding casing enclosing the insulating base.

2. The female USB connector according to claim 1, wherein the ground terminal, the first differential signal terminal, the second differential signal terminal, the third differential signal terminal, the fourth differential signal terminal, the first ground terminal, the first signal terminal, the second signal terminal, and the first power terminal are commonly connected to a printed circuit board by one of single-row SMT, single-row DIP, two-row SMT, and two-row DIP.

3. The female USB connector according to claim 1, wherein the integration to the insulating base by the ground terminal, the first differential signal terminal, the second differential signal terminal, the third differential signal terminal, the fourth differential signal terminal, the first ground terminal, the first signal terminal, the second signal terminal, and the first power terminal is one of insert and plugin.

4. A USB female connector, comprising an insulating base;

a metallic ground terminal on the insulating base having a ground contact section at an end of the insulating base and, from the ground contact section, extended toward the other end and forked into a plurality of ground extension sections;

a metallic first signal terminal on the insulating base between the ground extension sections;

a metallic second signal terminal on the insulating base between the a ground extension section and the first signal terminal;

a metallic first ground terminal on the insulating base at the side and parallel to the first signal terminal;

a metallic first differential signal terminal on the insulating base between a ground extension section and the first ground terminal;

a metallic second differential signal terminal on the insulating base between a ground extension section and the first differential signal terminal;

a metallic first power terminal on the insulating base at the side and parallel to the second signal terminal;

a metallic third differential signal terminal on the insulating base between a ground extension section and the first power terminal; and a metallic fourth differential signal terminal on the insulating base between the first power terminal and the third differential signal terminal.

5. The female USB connector according to claim 4, wherein the first signal terminal has a first signal contact section at an end on the insulating base, and a first signal extension section extended from the first signal contact section; the second signal terminal has a second signal contact section at an end on the insulating base, and a second signal extension section extended from the second signal contact section; the first differential signal terminal has a first differential signal contact section at an end on the insulating base, and a first differential signal extension section extended from the first differential signal contact section; the second differential signal terminal has a second differential signal contact section at an end on the insulating base, and a second differential signal extension section extended from the second differential signal contact section; the first power terminal has a first power contact section at an end on the insulating base, and a first power extension section extended from the first power contact section; the third differential signal terminal has a third differential signal contact section at an end on the insulating base, and a third differential signal extension section extended from the third differential signal contact section; and the fourth differential signal terminal has a fourth differential signal contact section at an end on the insulating base, and a fourth differential signal extension section extended from the fourth differential signal contact section.

6. The female USB connector according to claim 4, wherein the first differential signal terminal, the second differential signal terminal, the ground terminal, the third differential signal terminal, and the fourth differential signal terminal are structured as stable plates; and the first ground terminal, the first signal terminal, the second signal terminal, and the first power terminal are flexibly structured.

7. The female USB connector according to claim 4, wherein the insulating base is one of a printed circuit board, a 3D circuit board, and an insulating plastic member.

8. The female USB connector according to claim 5, wherein the first differential signal contact section, the second differential signal contact section, the ground contact section, the third differential signal contact section, and the fourth differential signal contact section are below and ahead of the first ground contact section, the first signal contact section, the second signal contact section, and the first power contact section.

9. A USB female connector, comprising an insulating base;

a metallic ground terminal on the insulating base having two ground soldering sections at one end;

a metallic first signal terminal on the insulating base having a first signal soldering section at one end between the ground soldering sections;

a metallic second signal terminal on the insulating base having a second signal soldering section at an end between a ground soldering section and the first signal soldering section;

a metallic first ground terminal on the insulating base having a first ground soldering section at an end parallel to the first signal soldering section;

a metallic first differential signal terminal on the insulating base having a first differential signal soldering section at an end between a ground soldering section and the first ground soldering section;

a metallic second differential signal terminal on the insulating base having a second differential signal soldering section at an end between the first differential signal soldering section and a ground soldering section;

a metallic first power terminal on the insulating base having a first power soldering section at an end parallel to the ground soldering sections;

a metallic third differential signal terminal on the insulating base having a third differential signal soldering section at an end between the first power soldering section and a ground soldering section; and a metallic fourth differential signal terminal on the insulating base having a fourth differential signal soldering section at an end between the third differential signal soldering section and the first power soldering section.

10. The female USB connector according to claim 9, wherein The ground soldering sections, the first signal soldering section, the second signal soldering section, the first ground soldering section, the first differential signal soldering section, the second differential signal soldering section, the first power soldering section, the third differential signal soldering section, the fourth differential signal soldering section are commonly connected to a printed circuit board by upward bending and extension, downward bending and extension, or continuous bending and extension; for upward bending and extension, it is one of flatly laid, raised, vertical, and upright; for downward bending and extension, it is one of laid or raised; and, for continuous bending and extension, it is one of forward and backward.

* * * * *